United States Patent [19]

Mancinelli et al.

[11] 3,951,705

[45] Apr. 20, 1976

[54] BLUE-BURNING TRACER MIX

[75] Inventors: Dennis J. Mancinelli, Philadelphia; Walter J. Puchalski, Southampton, both of Pa.

[73] Assignee: The United States of America as represented by the Secretary of the Army, Washington, D.C.

[22] Filed: May 14, 1975

[21] Appl. No.: 577,508

[52] U.S. Cl. ..... 149/41; 149/42; 149/44; 149/71; 149/82; 149/85

[51] Int. Cl.[2] ..... C06B 33/14

[58] Field of Search ..... 149/41, 42, 44, 71, 149/82, 85

[56] References Cited

UNITED STATES PATENTS 3,706,611 12/1972 Hastings et al. ..... 149/71 X

*Primary Examiner*—Stephen J. Lechert, Jr.

*Attorney, Agent, or Firm*—Nathan Edelberg; Robert P. Gibson; Kalman Pollen

[57] ABSTRACT

A blue-burning pyrotechnic tracer mix which provides a smoke trail even after the blue flame is no longer visible to thus extend the visible range of the projectile in which the mixture is employed, the pyrotechnic mixture comprising by weight percent: 6–10% potassium perchlorate, 11–18% magnesium, 10–20% cupric chloride anhydrous, 35–45% barium nitrate, 12–18% hexachlorobenzene, 5–10% sulfur.

3 Claims, No Drawings

BLUE-BURNING TRACER MIX

The invention described herein may be manufactured, used and licensed by or for the Government for governmental purposes without the payment to us of any royalty thereon.

This invention relates to pyrotechnics for small arms ammunition and more particularly to a blue burning pyrotechnic mixture which additionally provides a smoke trail even after the blue flame is no longer visible to thus extend the visible range of the tracer projectile in which it is employed.

Prior art blue-burning flare mixtures proved unsatisfactory. Under conventional tracer loading techniques and firing conditions, the tested prior art blue-burning flare mixtures either blew up, failed to ignite, or when ignition did occur the flame was an unsatisfactory whitish blue.

It is therefore an object of this invention to provide a substantially blue-burning pyrotechnic tracer mixture.

Another object of the invention is to extend the visible range of tracer ammunition.

These and other objects will be readily apparent from the following description.

Briefly, we have discovered a pyrotechnic mixture which upon being burned in a rearward cavity of a tracer projectile, will provide a substantially blue flame. Additionally, the mixture will provide a gray smoke trail even after the blue flame is no longer visible.

More specifically we have discovered that a pyrotechnic mixture comprising potassium perchlorate, magnesium, cupric chloride anhydrous, barium nitrate, hexachlorobenzene, and sulfur in the proportions listed in Table I below, will provide the desired blue flame and gray smoke trail:

TABLE I

PYROTECHNIC COMPOSITIONS

| Material | Effective Range % | Preferred |
|---|---|---|
| Potassium Perchlorate | 6–10 | 7.7 |
| Magnesium | 11–18 | 15.4 |
| Cupric Chloride Anhydrous | 10–20 | 15.4 |
| Barium Nitrate | 35–45 | 38.5 |
| Hexachlorobenzene | 12–18 | 15.3 |
| Sulfur | 5–10 | 7.7 |

In Table I, magnesium and sulfur serve as fuels, the magnesium acting as the primary heat source, whereas the sulfur, the $Ba^{++}$, and the cupric chloride anhydrous furnish blue color to the flame. Hexachlorobenzene along with potassium perchlorate serve as color intensifiers, the potassium perchlorate additionally serving as an oxidizer. Barium nitrate provides the primary oxidant. The principal smoke producers of the composition are sulfur and cupric chloride anhydrous.

When less than about 5 percent potassium perchlorate is present, the resulting insufficiency of chlorine may compromise proper color intensification of the flame, the lack of perchlorate oxidizer further jeopardizing smooth burning of the pyrotechnic mixture. Greater than about 10 percent potassium perchlorate in the composition may effect undesirable whitening of the flame.

Below the lower limit of magnesium, the burning mixture will not be sustained at an acceptable light level. On the other hand, a greater proportion than 18 percent magnesium tends to cause the flame to become whitish due to the formation of magnesium oxide. Moreover, excess magnesium also increases the burning rate of the mixture thus reducing its usefulness as an extended range tracer composition.

Cupric chloride anhydrous forms cuprous chloride as its principal oxidation product, which provides a blue color to the flame. Therefore, an insufficiency of cupric chloride anhydrous will generally impair the color value of the flame. Conversely, excess amounts of cupric chloride anhydrous may quench the burning mixture for lack of oxidizer or fuel.

Less than about 35 percent barium nitrate is generally insufficient for smooth and continuous burning of the mixture. As in the case of potassium perchlorate, excess barium nitrate tends to whiten the flame.

The flame will lack sufficient depth of color when below about 12% hexachlorobenzene is used. But excess amounts of this color intensifier may extinguish the reaction.

An insufficiency of sulfur may substantially diminish smoke formation as well as undesirably impair the color value of the flame. Because sulfur is cool burning, excess amounts of this substance may inhibit burning as well as reduce the light output of the pyrotechnic mixture.

A preferred blue burning mix that provides a readily discernible smoke trail is:

EXAMPLE I

| | Percent Weight |
|---|---|
| Potassium Perchlorate | 7.7 |
| Magnesium | 15.4 |
| Cupric Chloride Anhydros | 15.4 |
| Barium Nitrate | 38.5 |
| Hexachlorobenzene | 15.3 |
| Sulfur | 7.7 |

Another example is:

EXAMPLE II

| | Percent Weight |
|---|---|
| Potassium Perchlorate | 8.0 |
| Magnesium | 12.0 |
| Cupric Chloride Anhydrous | 16.0 |
| Barium Nitrate | 39.0 |
| Hexachlorobenzene | 15.0 |
| Sulfur | 10.0 |

We claim:

1. A pyrotechnic tracer mixture providing a substantially blue flame, said mixture comprising about 6–10% by weight of potassium perchlorate, about 11–18% by weight of magnesium, about 10–20% by weight of cupric chloride anhydrous, about 35–45% by weight of barium nitrate, about 12–18% by weight of hexachlorobenzene, and about 5–10% by weight sulfur, said pyrotechnic mixture additionally providing a smoke trail even after said blue flame is no longer visible so as to extend visible range of trace.

2. The mixture of claim 1 wherein said potassium perchlorate comprises about 7.7% by weight, said magnesium and said cupric chloride anhydrous each comprise about 15.4% by weight, said barium nitrate comprises about 38.5% by weight, said hexachlorobenzene comprises about 15.3% by weight, and said sulfur comprises about 7.7% by weight.

3. The mixture of claim 1 wherein said potassium perchlorate comprises about 8.0% by weight, said magnesium comprises about 12% by weight, said cupric chloride anhydrous comprises about 16% by weight, said barium nitrate comprises about 39.0% by weight, said hexachlorobenzene comprises about 15.0% by weight, and said sulfur comprises about 10.0% by weight.

* * * * *